US005219718A

United States Patent [19]

Hatakeyama et al.

[11] Patent Number: 5,219,718

[45] Date of Patent: Jun. 15, 1993

[54] SILVER HALIDE PHOTOGRAPHIC MATERIAL

[75] Inventors: Akira Hatakeyama; Takashi Naoi; Kunio Ishigaki, all of Kanagawa, Japan

[73] Assignee: Fuji Photo Film Co., Ltd., Kanagawa, Japan

[21] Appl. No.: 886,397

[22] Filed: May 21, 1992

[30] Foreign Application Priority Data

| | | | |
|---|---|---|---|
| May 22, 1991 | [JP] | Japan | 3-145168 |
| Oct. 30, 1991 | [JP] | Japan | 3-310119 |
| Oct. 31, 1991 | [JP] | Japan | 3-355380 |
| Jan. 16, 1992 | [JP] | Japan | 4-5818 |

[51] Int. Cl.[5] ..... G03C 1/76

[52] U.S. Cl. ..... 430/531; 430/523; 430/527; 430/529; 430/535; 430/536; 430/539

[58] Field of Search ..... 430/523, 539, 930, 527, 430/535, 529, 950, 531, 536

[56] References Cited

U.S. PATENT DOCUMENTS

| | | | |
|---|---|---|---|
| 1,846,230 | 2/1932 | Stuber | 430/930 |
| 4,547,445 | 10/1985 | Asahina et al. | 430/533 |
| 4,585,730 | 4/1986 | Cho | 430/523 |
| 4,672,776 | 8/1988 | Uesawa et al. | 430/539 |
| 4,675,278 | 6/1987 | Sugimoto et al. | 430/523 |
| 4,891,308 | 1/1990 | Cho | 430/525 |
| 4,940,655 | 7/1990 | Gundlach | 430/527 |
| 5,070,005 | 12/1991 | Arai et al. | 430/523 |
| 5,870,006 | 12/1991 | Krafft et al. | 430/930 |

*Primary Examiner*—Jack P. Brammer

*Attorney, Agent, or Firm*—Sughrue, Mion, Zinn, Macpeak & Seas

[57] ABSTRACT

There is disclosed a silver halide photographic material having the improved drying, anticurl and pin hole properties. The photographic material comprises (a) a support, (b) at least one silver halide emulsion layer containing hydrophilic colloid as a binder provided on one side of the support (side A), and (c) at least one light-insensitive layer containing hydrophilic colloid as a binder provided on the side of the support opposite from the side with the silver halide emulsion layer (side B), wherein a weight ratio of the hydrophilic colloid contained in the at least one light-insensitive layer on side B to the hydrophilic colloid in the at least one silver halide emulsion layer on side A is 0.3 or greater, and the light-insensitive layer on side B has a water content of 0.2 g or less per gram of hydrophilic colloid after finishing a rinsing step in development processing.

20 Claims, No Drawings

SILVER HALIDE PHOTOGRAPHIC MATERIAL

FIELD OF THE INVENTION

The present invention relates to a silver halide photographic material, specifically to a silver halide photographic material having an improved drying property after development processing.

BACKGROUND OF THE INVENTION

In recent years, the shortening of developing time has been sought in a silver halide photographic material having an improved drying property after development processing.

A method to improve the drying property to shorten drying time results in shortening of developing time and includes reducing the binder amount contained in a silver halide photographic material. However, this method may result in problems such as the reduction of the dynamic strength of a silver halide photographic material, blackening of a scratch and the generation of roller marks.

The blackening of a scratch is a phenomenon that if the surface of the film is rubbed in handling the silver halide photographic material before subjecting it to development processing, then this rubbed portion is scratchwise blackened after the development processing. The generation of roller marks occurs if pressure is exerted on the silver halide photographic material by rollers which have fine irregularities during automatic development processing which generates a black spotwise density unevenness.

Both the blackened scratches and roller marks markedly deteriorate the commercial value of the silver halide photographic material.

Another method for improving the drying property is to increase the amount of hardener added to the silver halide photographic material. In this method, swelling of the silver halide photographic material during development processing is lowered, so that the drying property is improved.

However, this method causes problems such as lowering of sensitivity due to delayed development, reduction of covering power, residual silver due to delayed fixing, and residual color, so that the drying property can not be sufficiently improved.

Another method, where a silver halide photographic material comprising a silver halide emulsion layer provided only on one side of a support (hereinafter referred to as a single-sided light-sensitive material) is used, includes removing a light-insensitive hydrophilic colloid layer provided on the backside of the support or replacing a binder contained in a light-insensitive layer provided on the backside of the support with a hydrophobic binder to thereby improve the drying property. However, this method causes curling of the silver halide photographic material and notably deterioration and, therefore, is not suitable for practical use.

Also, the reduction of the amount of binder contained in a silver halide photographic material results in deterioration of the pin hole property of the silver halide photographic material. This pin hole is known as a starry night and occurs when a small white spot is formed on an image of the silver halide photographic material after development processing, which lowers the practical value of the silver halide photographic material to a large extent. The pin hole apparently occurs when an agglomerate of a matting agent or matting agent particles having a particularly large particle size added to the silver halide photographic material push away the silver halide grains contained in an emulsion layer.

Further, occurrence of the pin hole may be caused by dust. A pin hole attributable to dust of this type occurs when the silver halide photographic material is exposed through a silver halide photographic material which contains dust where traces of dust remain as white spots. Overall, the pin hole is a serious problem for printing photographic material and considerable labor is spent to improve this occurrence.

A method in which a surface active agent is added to a silver halide photographic material to improve the electrification property can be used to improve the pin hole property. However, this method is not sufficient because the improvement is not significant and the improvement of the electrification property is lost after development processing. Consequently, if improvement of the electrification property is not demonstrated, dust would not be prevented from sticking to a manuscript film (a film after development processing) and the pin hole property would not be improved.

SUMMARY OF THE INVENTION

The first object of the present invention is to provide a silver halide photographic material having a good drying property after development processing.

The second object of the present invention is to provide a silver halide photographic material having an improved anticurl property.

The third object of the present invention is to provide a silver halide photographic material having an improved pin hole property.

The above and other objects and advantages of the present invention have been achieved by a silver halide photographic material comprising (a) a support, (b) at least one silver halide emulsion layer containing hydrophilic colloid as a binder provided on one side of the support (side A), and (c) at least one light-insensitive layer containing hydrophilic colloid as a binder provided on the side of the support opposite from the side with the silver halide emulsion layer (side B), wherein a weight ratio of the hydrophilic colloid contained in the at least one light-insensitive layer on side B to the hydrophilic colloid in the at least one silver halide emulsion layer on side A is 0.3 or greater, and the light-insensitive layer on side B has a water content of 0.2 g or less per gram of hydrophilic colloid after finishing a rinsing step in development processing.

DETAILED DESCRIPTION OF THE INVENTION

Side B of the support opposite to the silver halide emulsion layer side is hereinafter referred to as a back side and the light-insensitive hydrophilic colloid layer provided on side B is hereinafter referred to as a back layer.

Gelatin is most preferably used as the hydrophilic colloid which functions as a binder in the back layer.

Any gelatins can be used such as lime-treated gelatin, acid-treated gelatin, enzyme-treated gelatin, a gelatin derivative, and modified gelatin. Lime-treated gelatin and acid-treated gelatin are most preferably used.

Other than gelatin, proteins such as colloidal albumin and casein, sugar derivatives such as agar, sodium alginate and starch derivatives, cellulose compounds such as carboxymethyl cellulose and hydroxymethyl cellulose, and synthetic hydrophilic compounds such as polyvinyl alcohol, poly-N-vinylpyrrolidone and polyacrylamide can be used as the hydrophilic colloid.

Other components may be copolymerized with the synthetic hydrophilic compounds, but if the hydrophobic copolymerizable components are too great such as more than about 50 wt %, the moisture absorbing amount and moisture absorbing speed of the back layer would be lowered. Therefore, it may not be recommended in view of the problem of curling and copolymerization should only be used if the above-described result would not occur.

The hydrophilic colloids may be used singly or in combination.

The content of the hydrophilic colloids contained in the back layer is preferably in a range of 0.3 to 20 g/m$^2$.

A matting agent, a surface active agent, a dye, a cross-linking agent, a thickener, a preservative, a UV absorber, and an inorganic fine particle such as colloidal silica may be added to the back layer in addition to a binder. These additives are further described in *Research Disclosure,* Vol. 176, Chapter 17643 (December, 1978).

A polymer latex may also be added to the back layer. The polymer latex used in the present invention is a dispersion of a water insoluble polymer having an average particle diameter of 20 to 200 mμ. Preferably, the amount of latex used is 0.01 to 1.0 g, more preferably 0.1 to 0.8 g, per gram of a binder of the back layer on a dry basis.

Preferred examples of the polymer latex used in the present invention include polymers with an average molecular weight of 100,000 or more, more preferably 300,000 to 500,000, which have as a monomer unit alkyl ester, hydroxyalkyl ester or glycidyl ester of acrylic acid or methacrylic acid. Examples of the latex are shown by the following formulas but should not be construed as limiting:

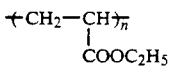
Polymer 1

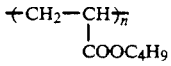
Polymer 2

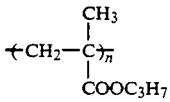
Polymer 3

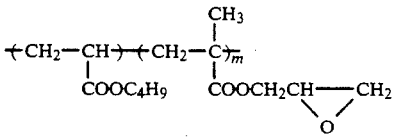
Polymer 4

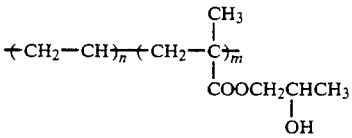
Polymer 5

-continued

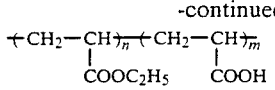
Polymer 6

In the above formulas, n=1,000 to 10,000, m=1,000 to 10,000.

Methods for providing the back layer according to the present invention are not specifically limited. Any method for providing a hydrophilic colloid layer of a silver halide photographic material can be used. Examples include a dip coating method, an air knife coating method, a curtain coating method, a roller coating method, a wire bar coating method, a gravure coating method, an extrusion method described in U.S. Pat. No. 2,681,294, in which a hopper is used, and a multilayer simultaneous coating method described in U.S. Pat. Nos. 2,761,418, 3,508,947 and 2,761,791.

The weight ratio of the total amount of hydrophilic colloid contained in the at least one back layer according to the present invention to the total amount of hydrophilic colloid contained in the at least one silver halide emulsion layer on side A is 0.3 or greater, preferably 0.5 to 1.5. The value of the weight ratio depends on the total amount of hydrophilic colloid contained in the silver halide photographic material, the coated silver amount and the thickness of the support. A value which is too small deteriorates anticurl property.

The back layer of the silver halide photographic material of the present invention has a water content of 0.2 g or less per gram of hydrophilic colloid contained in the back layer after the completion of a rinsing step in the development processing. However, the water content cannot be maintained at 0.2 g or less per gram of hydrophilic colloid by a method in which the amounts of hydrophilic colloid and a cross-linking agent contained in the back side are controlled without deteriorating anticurl property. Therefore, a method in which a hydrophobic polymer layer according to the present invention, which will be described below, is provided for preventing swelling of the back layer closer to a support than this layer which results in lowering the water content after development processing is preferred.

Otherwise, however, there is no specific limit to the means for maintaining the water content of the back layer of the silver halide photographic material of the present invention at 0.2 g or less per gram of hydrophilic colloid after the completion of a rinsing step in the development processing.

In the present invention, the water content is calculated from the following equation:

$$(W_1-W_2)/(S\times X)$$

wherein $W_1$ is the weight (g) of the back layer after the completion of a rinsing step, $W_2$ is the weight (g) of the back layer after drying at 5 Torr and 105° C. for 24 hours, S is a back layer area (m$^2$) and X is a gelatin coated amount (g/m$^2$) contained in the back layer.

The back layer according to the present invention may consist of a single layer or two or more layers. Where the back layer consists of a single layer, at least one hydrophobic polymer layer is preferably provided as an adjacent layer provided farther from a support than the back layer. Also, where the back layer consists of two or more layers, at least one hydrophobic polymer layer according to the present invention is preferably provided as an adjacent layer provided farther from a support than at least one of the two or more back layers.

The total thickness of the at least one back layer is preferably in the range of from 0.3 to 20 μm.

The hydrophobic polymer layer (hereinafter referred to as a polymer layer) is a layer containing a hydrophobic polymer as a binder. Further, the binder used for the polymer layer may be a homopolymer consisting of a single monomer and a copolymer consisting of two or more monomers.

Non-limiting examples of the binder used for the polymer layer include water insoluble polymers or derivatives thereof such as polyethylene, polypropylene, polystyrene, polyvinyl chloride, polyvinylidene chloride, polyacrylonitrile, polyvinyl acetate, urethane resin, urea resin, melamine resin, phenol resin, epoxy resin, fluorinated resin including tetrafluoroethylene and polyfluorinated vinylidene, rubber including butadiene rubber, chloroprene rubber and natural rubber, polyacrylate or polymethacrylate including polymethyl methacrylate and polyethyl acrylate, polyester resin including polyethylene phthalate, polyamide resin including nylon 6 and nylon 66, cellulose resin including cellulose triacetate, and a silicone resin.

Particularly preferred polymers include a copolymer of alkyl acrylate or alkyl methacrylate and acrylic acid or methacrylic acid (the content of acrylic acid or methacrylic acid is preferably 5 mole % or less), a copolymer of styrene and butadiene, a copolymer of styrene, butadiene and acrylic acid (the content of acrylic acid is preferably 5 mole % or less), a copolymer of styrene, butadiene, divinylbenzene and methacrylic acid (the content of methacrylic acid is preferably 5 mole % or less), a copolymer of vinyl acetate, ethylene and acrylic acid (the content of acrylic acid is 5 mole % or less), a copolymer of vinylidene chloride, acrylonitrile, methyl methacrylate, ethyl acrylate and acrylic acid (the content of acrylic acid is 5 mole % or less), and a copolymer of ethyl acrylate, glycidyl methacrylate and acrylic acid.

These polymers may be used singly or in combination.

The hydrophobic polymer which can be used in the present invention preferably has a molecular weight of from 10,000 to 3,000,000.

The hydrophobic polymer layer preferably comprises the hydrophobic polymer binder in an amount of 60 to 100 wt %.

Photographic additives such as a matting agent, a surface active agent, a dye, a sliding agent, a thickener, a UV absorber, and inorganic fine particles including colloidal silica may be incorporated into the polymer layer.

Examples of these additives include those described in *Research Disclosure,* Vol. 176, Chapter 17643 (December, 1978).

The thickness of the polymer layer according to the present invention is not specifically limited but depends on the physical properties of the binder. However, if the layer is too thin, the thickness will be inadequate since it is not sufficiently waterproof and results in swelling of the back layer in the processing solution. On the contrary, if the layer is too thick, the moisture permeating property of the polymer layer becomes insufficient and absorption and desorption of moisture in the hydrophilic colloid contained in the back layer are prevented which results in deterioration of the anticurl property.

Accordingly, the thickness has to be determined taking the above matters into consideration. The preferred thickness of the polymer layer depends on the kind of binder and is in the range of 0.05 to 10 μm, more preferably 0.1 to 5 μm. Where the polymer layer according to the present invention consists of two or more layers, the sum of the thicknesses of all polymer layers is regarded as the thickness of the polymer layer of the silver halide photographic material.

The method for providing the polymer layer according to the present invention is not specifically limited. After drying the back layer, the polymer layer may be coated thereon, followed by drying, or the back layer and polymer layer may be simultaneously coated, followed by drying.

The polymer layer may be provided in a solvent system, in which the polymer is dissolved in a solvent, or it may be provided in an aqueous system, in which the polymer is dispersed in water to form a dispersion.

A method in which the water content in the back side of the silver halide photographic material after the completion of a rinsing step in development processing is 0.2 g or less per gram of hydrophilic colloid also includes the method in which a water insoluble fluorinated surface active agent is coated on the surface of the back layer to provide the surface with water repellency in order to prevent the back layer from swelling in development processing. Specifically a method can be used in which, after coating the back layer and then drying it, a fluorinated surface active agent dissolved in a solvent such as ethyl acetate and methanol is coated thereon, followed by drying.

Examples of the fluorinated surface active agent include, for example, $C_8F_{17}SO_3K$, $C_8F_{17}SO_2N(C_3H_7)(CH_2CH_2O)_3H$, and $C_8F_{17}SO_2N(C_3H_7)(CH_2CH_2O)CH_3$.

The coated amount of the fluorinated surface active agent is 1 to 100 mg/m$^2$, preferably 3 to 50 mg/m$^2$.

In order to improve the problem of pin hole, a surface resistivity of at least one side is preferably $10^{12}\Omega$ or less, more preferably $10^{10}$ to $10^{11}\Omega$ at 25° C. and 25% relative humidity (RH).

The means for lowering the surface resistivity of the silver halide photographic material is not specifically limited. A preferred method is the method in which at least one electrically conductive material is incorporated into a silver halide photographic material to provide an electrically conductive layer.

Electrically conductive metal oxides and electrically conductive high molecular weight compounds are used as the electrically conductive material for the electrically conductive layer.

The electrically conductive metal oxide preferably used is crystalline metal oxide particles. Particularly preferred are electrically conductive metal oxides having an oxygen deficiency and containing a small amount of different kinds of atoms which form donors for metal oxides since in general they are highly electrically conductive. These are particularly preferred since they do not fog the silver halide emulsion.

Examples of the metal oxide include ZnO, $TiO_2$, $SnO_2$, $Al_2O_3$, $In_2O_3$, $SiO_2$, MgO, BaO, $MoO_3$, $V_2O_5$, and composite oxides thereof. ZnO, $TiO_2$ and $SnO_2$ are particularly preferred. Examples of metal oxides containing different kinds of atoms include, for example, ZnO containing Al and In, $SnO_2$ containing Sb, Nb and a halogen atom, and $TiO_2$ containing Nb and Ta.

The amount of different kinds of atoms used is preferably in the range of 0.1 to 30 mol %, particularly preferably 0.1 to 10 mol % based on the metal of the electrically conductive metal oxide used.

The electrically conductive metal oxide fine particles have an electrical conductivity and a volume resistivity of $10^9$ Ω-cm or less, more preferably $10^5$ Ω-cm or less. The volume resistivity is measured according to *Handbook For Super Fine Particles*, p. 168, published by Fuji Techno System (1990). These oxides include those described in JP-A-56-143431, JP-A-56-12051 and JP-A-58-62647 (the term "JP-A" as used herein means an unexamined published Japanese patent application).

Further, other crystalline metal oxide particles or electrically conductive materials prepared by depositing the above metal oxides on a fibrous material (for example, titanium oxide) may be used, as described in JP-B-59-6235 (the term "JP-B" as used herein means an examined Japanese patent publication).

The usable particle size of the electrically conductive metal oxide particles is preferably 10 μm or less. Preferably, the particle size is 2 μm or less which improves a stability after dispersing and, therefore, it is easy to use. The use of the electrically conductive particles with a particle size of 0.5 μm or less for reducing the light scattering property is more preferred since it makes it possible to form a transparent light-sensitive material.

Further, where the electrically conductive materials are made of needles or fiber, the length of the needles or fiber is preferably 30 μm or less and the diameter is or less, the diameter is 0.5 μm or less, and the ratio of length/diameter is 3 or more.

Preferred electrically conductive high molecular weight compounds include, for example, polyvinylbenzenesulfonic acid salts, polyvinylbenzyl trimethylammonium chloride, quaternary salt polymers described in U.S. Pat. Nos. 4,108,802, 4,118,231, 4,126,467, and 4,137,217, and polymer latexes described in U.S, Pat. No. 4,070,189, German Patent Application (OLS) 2,830,767, and JP-A-61-296352 and JP-A-61-62033.

Examples of the electrically conductive high molecular weight compound according to the present invention are shown below but not necessarily limited thereto.

P-1

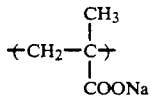

P-2

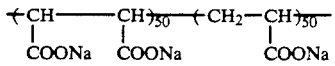

P-3

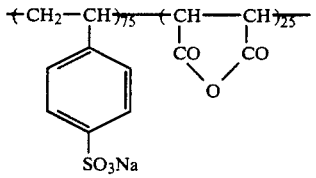

P-4

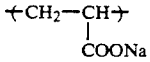

-continued

P-5

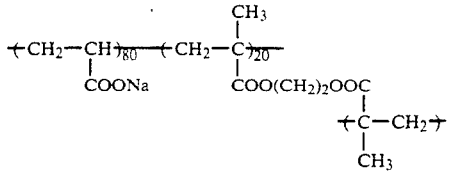

P-6

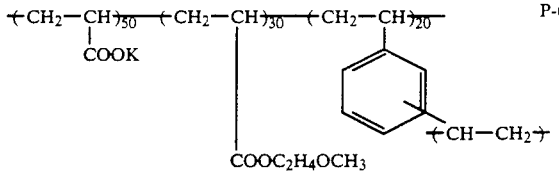

P-7

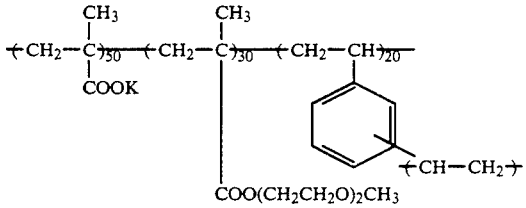

The electrically conductive metal oxides or electrically conductive high molecular weight compounds are dispersed or dissolved in a binder. The binders in which the electrically conductive metal oxides or electrically conductive high molecular weight compounds are dissolved are not specifically limited as long as they have a film forming capability. Examples include, for example, proteins such as gelatin and casein, a cellulose derivative such as carboxymethyl cellulose, hydroxyethyl cellulose, acetyl cellulose, diacetyl cellulose, and triacetyl cellulose, sugars such as dextran, agar, sodium alginate, a starch derivative, and synthetic polymers such as polyvinyl alcohol, polyvinyl acetate, polyacrylic acid ester, polymethacrylic acid ester, polystyrene, polyacrylamide, poly-N-vinylpyrrolidone, polyester, polyvinyl chloride, and polyacrylic acid.

A higher volume content of the electrically conductive material in the electrically conductive layer is preferred for the purpose of lowering resistance of the electrically conductive layer by more effectively using the electrically conductive metal oxides or electrically conductive high molecular weight compounds but a binder in an amount of at least 5% based on the total volume of the electrically conductive layer is necessary and, therefore, a volume content of electrically conductive metal oxide or electrically conductive high molecular weight compound is preferably in the range of 5 to 95% based on the total volume of the electrically conductive layer.

The total amount of the electrically conductive metal oxides or electrically conductive high molecular weight compounds used is preferably 0.05 to 20 g per $m^2$ of photographic material, more preferably 0.1 to 10 g per $m^2$ of photographic material. The surface resistivity of the electrically conductive layer is $10^{12}$Ω or less, preferably $10^{11}$Ω or less.

The electrically conductive layer preferably has a thickness of from 0.01 to 1 μm.

The at least one electrically conductive layer containing the electrically conductive metal oxides or electrically conductive high molecular weight compounds is provided as a constituent layer for the photographic material. For example, it may be any of a surface protective layer, a back layer, an intermediate layer and a subbing layer. Two or more electrically conductive layers may be provided according to necessity.

The support used for the silver halide photographic material is not specifically limited, and any known supports can be used. Polyethylene terephthalate and triacetyl cellulose are preferred examples of the support. The support preferably has a thickness of from 70 to 200 μm.

In the silver halide photographic material of the present invention there is at least one silver halide emulsion layer.

In general, the silver halide emulsion used for the photographic material is prepared by mixing a water soluble silver salt (for example, silver nitrate) solution with a water soluble halide (for example, potassium bromide) solution in the presence of a water soluble high molecular compound solution such as gelatin.

Silver chloride, silver bromide, silver chlorobromide, silver iodobromide, and silver chloroiodobromide can be used as the silver halide grains. Grain form and grain size distribution are not specifically limited.

The silver halide grains may be of a tabular form having an aspect ratio of 3 or more, a pebble-like form, cube or octahedron. Besides the silver halide emulsion layer, a surface protective layer, an intermediate layer, and an antihalation layer may be provided. The surface protective layer may be two or more layers.

Next, the subbing layer according to the present invention will be explained.

The subbing layer which can be used in the present invention is a layer containing vinylidene chloride copolymer having a thickness of at least 0.3 μm.

Preferably used as a vinylidene chloride copolymer used for the subbing layer in the present invention is a vinylidene chloride copolymer containing vinylidene chloride of 70 to 99.9% by weight, more preferably 85 to 99% by weight.

The vinylidene chloride copolymer according to the present invention can contain a monomer which is different from vinylidene chloride and is copolymerizable therewith.

There can be given as the examples of these monomers, acrylonitrile, methacrylonitrile, methyl acrylate, ethyl acrylate, butyl acrylate, methyl methacrylate, butyl methacrylate, glycidyl methacrylate, 2-hydroxyethyl methacrylate, vinyl acetate, acrylamide, methyl acrylamide, methyl methacrylamide, methyl vinyl ether, and styrene. These monomers may be used singly or in combination of two or more kinds.

Acrylic acid, methacrylic acid, itaconic acid and citraconic acid can be given as a vinyl monomer which is used for the vinylidene chloride copolymer according to the present invention and has one or more carboxyl groups.

A dispersion of a latex in water is preferred as the vinylidene chloride copolymer according to the present invention, wherein there may be used in addition to a conventional latex having a uniform structure, a so-called core/shell type latex in which a core portion and a shell portion of a latex grain are of a different structure.

The following copolymers can be given as the concrete examples of the vinylidene chloride copolymer. The number in a parenthesis represents % by weight.

V-1: vinylidene chloride:acrylic acid:methyl acrylate (90:1:9)

V-2: vinylidene chloride acrylic acid methyl methacrylate (90:1:9)

V-3: vinylidene chloride:methacrylic acid:methyl methacrylate (90 : 0.5 : 9.5)

V-4: vinylidene chloride:methacrylic acid:ethyl acrylate:methyl methacrylate (90:0.5:5:4.5)

V-5: vinylidene chloride:acrylic acid:methyl acrylate:methyl methacrylate (90:0.5:5:4.5)

V-6: vinylidene chloride:acrylic acid:methyl methacrylate:acrylonitrile (90:0.3:8:1.7)

V-7: vinylidene chloride:methacrylic acid:methyl methacrylate:methacrylonitrile (80:3:10:7)

V-8: vinylidene chloride:acrylic acid:methyl acrylate:glycidyl methacrylate (90:0.3:6.7:3)

V-9: vinylidene chloride:methacrylic acid:methyl methacrylate:2-hydroxyethyl methacrylate (90:0.5:5.5:4)

V-10: vinylidene chloride:methacrylic acid:methyl methacrylate:butyl methacrylate:acrylonitrile (75:5:10:5:5)

V-11: vinylidene chloride:acrylic acid:methyl acrylate:ethyl acrylate:acrylonitrile (90:0.3:3:3:3.7)

V-12: vinylidene chloride:methacrylic acid:methyl acrylate:methyl methacrylate:methacrylonitrile (80:5:5:5:5)

V-13: vinylidene chloride:methacrylic acid:methyl acrylate:methyl methacrylate:acrylonitrile (90:0.3:4:4:1.7)

V-14: vinylidene chloride:acrylic acid:methyl acrylate:methyl methacrylate:acrylonitrile (90:0.3:4:4:1.7)

V-15: vinylidene chloride:methacrylic acid:methyl methacrylate:glycidyl methacrylate:acrylonitrile (90:0.5:3.5:3:3)

V-16: (a dispersion of a core/shell type latex in water: a core portion of 90% by weight and a shell portion of 10% by weight)

Core portion:vinylidene chloride:methyl acrylate:methyl methacrylate:acrylonitrile:acrylic acid (93:3:3:0.9:0.1)

Shell portion:vinylidene chloride:methyl acrylate:methyl methacrylate:acrylonitrile:acrylic acid (90:3:3:2:2)

In addition to the vinylidene chloride copolymer, a crosslinking agent, a matting agent, a surface active agent, acid or alkali for adjusting pH, and a dye may be added to the subbing layer according to the present invention according to necessity.

The compounds described in JP-A-3-141347 are particularly preferred as the crosslinking agent.

There are no limitations to the methods for forming the subbing layer according to the present invention. Preferred is the method in which an aqueous coating solution containing a dispersion of the vinylidene chloride copolymer in water is applied on a polyester support-by a publicly known method and dried, wherein the publicly known methods such as an air knife coater, a bar coater and a roll coater can be used as the method for coating the aqueous coating solution on the polyester support.

The aqueous coating solution may be cooled to 5° to 15° C. in coating according to necessity.

The swelling rate of the hydrophilic colloid layers provided on an emulsion layer side including an emulsion layer and a protective layer of the silver halide photographic material according to the present invention is preferably 200% or less, particularly preferably 50 to 150%.

It has been found that the swelling rate exceeding 200% not only causes the reduction of the wet layer strength but also is liable to cause the jamming at a drying unit of an automatic developing machine. Also, the swelling rate less than delays a developing speed and a fixing speed and adversely affects the photographic properties.

There are measured the thickness ($d_0$) of the hydrophilic colloid layers including the emulsion layer and protective layer of the above silver halide photographic silver halide photographic material in distilled water of 25° C. for one minute to obtain the swelling rate of the hydrophilic colloid layers in the present invention from the following equation:

$$\text{Swelling rate } (\%) = (\Delta d \div d_0) \times 100$$

The thickness can be measured according to the same theory as an electron micrometer described in JIS B7536. For example, it can be measured with an electron micrometer (K 360 type) manufactured by Anritsu Electric Co., Ltd.

There is available as the concrete method for arbitrarily controlling the swelling rate of the hydrophilic colloid layers including a silver halide emulsion layer and a protective layer in the present invention, the method in which an inorganic or organic gelatin hardener is used singly or in combination thereof. There can be preferably used singly or in combination thereof, for example, active vinyl compounds (1,3,5-triacryloyl-hexahydro-s-triazine, bis(vinylsulfonyl) methyl ether, and N,N,-methylenebis-[β-(vinylsulfonyl) propionamide]), active halogen compounds (2,4-dichloro-6-hydroxy-s-triazine), mucohalogen acids (mucochloric acid), N-carbamoylpyridinium salts [1-morpholino-carbonyl-3-pyridinio) methanesulfonate], and haloamidinium salts [1-(1-chloro-1-pyridinomethylene) pyrrolidinium and 2-naphthalenesulfonate). Among them, preferred are the active vinyl compounds described in JP-A-53-41220, JP-A-53-57257, JP-A-59-162546 and JP-A-60-80846, and the active halogen compounds described in U.S. Pat. No. 3,325,287.

The various additives and development processing methods used for the photographic material are not specifically limited, and the following corresponding portions describe preferable applications but the invention is not limited thereto. The portions also reference additional descriptions for the polymer latex.

| Subject | Corresponding portion |
|---|---|
| 1) Silver halide emulsion and production process thereof | p. 20, right lower column, line 12 to p. 21, left lower column, line 14 of JP-A-2-97937; and p. 7, right upper column, line 19 to p. 8, left lower column, line 12 of JP-A-2-12236 |
| 2) Spectral sensitizing dye | p. 7, left upper column, line 8 to p. 8, right lower column, line 8 of JP-A-2-55349 |
| 3) Surface active agent and anti-electrification agent | p. 9, right upper column, line 7 to right lower column, line 7 of JP-A-2-12236; and p. 2, left lower column, line 13 to p. 4, right lower column, line 18 of JP-A-2-18542 |
| 4) Anti-foggant and stabilizer | p. 17, right lower column, line 19 to p. 18, right upper column, line 4 and p. 18, right lower column, lines 1 to 5 of JP-A-2-103526 |

-continued

| Subject | Corresponding portion |
|---|---|
| 5) Polymer latex | p. 18, left lower column, lines 12 to 20 of JP-A-2-103526 |
| 6) Compound having an acid group | p. 18, right lower column, line 6 to p. 19, left upper column, line 1 of JP-A-2-103526; and p. 8, right lower column, line 13 to p. 11, left upper column, line 8 of JP-A-2-55349 |
| 7) Polyhydroxybenzene | p. 11, left upper column, line 9 to right lower column, line 17 of JP-A-2-55349 |
| 8) Matting agent, sliding agent and plasticizer | p. 19, left upper column, line 15 to right upper column, line 15 of JP-A-2-103526 |
| 9) Hardener | p. 18, right upper column, lines 5 to 17 of JP-A-2-103536 |
| 10) Dye | p. 17, right lower column, lines 1 to 18 of JP-A-2-103536 |
| 11) Binder | p. 3, right lower column, lines 1 to 20 of JP-A-2-18542 |
| 12) Developing solution and developing method | p. 13, right lower column, line 1 to p. 16, left upper column, line 10 of JP-A-2-55349 |

The present invention can be applied to a silver halide photographic material such as light-sensitive material for printing, a light-sensitive material for a micro film, an X-ray sensitive material for medical use, an X-ray sensitive material for industrial use, negative light-sensitive material, and reversal light-sensitive material.

EXAMPLES

The present invention will be explained in more detail with reference to the examples but is not limited thereto.

EXAMPLE 1

A back layer and a polymer layer each having the following composition were simultaneously coated with the back layer closest to the support on one side of a polyethylene terephthalate support provided on both sides thereof with a subbing layer and having a thickness of 180 μm, followed by drying at 50° C. for 5 minutes.

(1) Composition of the Back Layer (Samples 102, and 104 to 112)

| Gelatin | coated amount as shown in Table 1 |
|---|---|
| Polymethyl methacrylate fine particles (average particle size: 3 μm) | 50 mg/m$^2$ |
| Sodium dodecylbenzenesulfonate | 10 mg/m$^2$ |
| Poly-sodium styrenesulfonate | 20 mg/m$^2$ |
| N,N'-ethylenebis-(vinylsulfonacetamide) | 3% based on gelatin |
| Polyethyl acrylate latex (average particle size: 0.1 μm) | 1.0 g/m$^2$ |

(2) Composition of the Polymer Layer (Samples 103 to 110)

| Binder | coated amount as shown |
|---|---|

-continued

| | |
|---|---|
| (kind as shown in Table 1 and described below) | in Table 1 |
| Polymethyl methacrylate fine particles (average particle size: 3 μm) | 10 mg/m$^2$ |
| $C_8F_{17}SO_3K$ | 5 mg/m$^2$ |

Distilled water was used as a solvent for the coating solution.

| | |
|---|---|
| B-1 | latex of methyl methacrylate and acrylic acid (97:3). |
| B-2 | latex of butyl methacrylate and methacrylic acid (97:3). |
| B-3 | latex of ethyl acrylate and acrylic acid (97:3). |
| B-4 | latex of styrene, butadiene and acrylic acid (30:68:2). |
| B-5 | latex of styrene, butadiene, divinylbenzene and methacrylic acid (20:72:6:2). |
| B-6 | latex of vinyl acetate, ethylene and acrylic acid (78:20:2). |
| B-7 | latex of vinylidene chloride, acrylonitrile, methyl methacrylate, ethyl methacrylate and acrylic acid (90:1:4:4:1). |

Composition of the Polymer Layer (Sample 111)

| | |
|---|---|
| Gelatin | coated amount as shown in Table 1 |
| Sodium dodecylbenzenesulfonate | 15 mg/m$^2$ |
| N,N'-ethylenebis-(vinylsulfonacetamide) | 3% by weight based on gelatin |
| Polymethyl methacrylate fine particles (average particle size: 3 μm) | 10 mg/m$^2$ |

Next, an emulsion layer and a surface protective layer were coated with the emulsion layer closest to the support on the opposite side of the support.

(3) Composition of the Emulsion Layer

Preparation of the Silver Halide Emulsion Layer 40 g of gelatin dissolved in 1 liter of water, 6 g of sodium chloride, 0.4 g of potassium bromide and 60 mg of the following compound (I) were put into a reaction vessel heated at 53° C.:

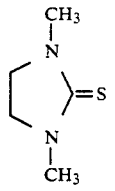

(I)

Next, 600 ml of an aqueous solution containing 100 g of silver nitrate and 600 ml of an aqueous solution containing 56 g of potassium bromide and 7 g of sodium chloride were simultaneously added to the reaction vessel by a double jet method to form a core portion having a silver chloride content of 20 mol %. Then, 500 ml of an aqueous solution containing 100 g of silver nitrate and 500 ml of an aqueous solution containing 40 g of potassium bromide, 14 g of sodium chloride and potassium hexachloroiridate (III) (10.7 mole/mole of silver) were simultaneously added by the double jet method to form a shell portion having a silver chloride content of 40 mol %, whereby the core/shell type monodispersed silver chlorobromide grains having an average grain size of 0.35 μm were prepared.

After subjecting this emulsion to a desalting treatment, 40 g of gelatin were added, and pH and pAg were adjusted to 6.0 and 8.5, respectively. Then, 2 mg of triethyl thiourea, 4 mg of chloroauric acid and 0.2 g of 4-hydroxy-6-methyl-1,3,3a,7-tetraazaindene were added to provide a chemical sensitization at 60° C. (Emulsion A).

Preparation of the Emulsion Coating Solution

The following additives were added to the vessel which contained 850 g of Emulsion A and heated at 40° C., to thereby prepare the emulsion coating solution.

Composition A of the Emulsion Coating Solution

| | |
|---|---|
| a. Emulsion A | 850 g |
| b. Spectral sensitizer (II) | $1.2 \times 10^{-4}$ mole |
| c. Supersensitizer (III) | $0.8 \times 10^{-3}$ mole |
| d. Preservation improving agent (IV) | $1 \times 10^{-3}$ mole |
| e. Polyacrylamide (molecular weight: 40,000) | 7.5 g |
| f. Trimethylolpropane | 1.6 g |
| g. Poly-sodium styrenesulfonate | 2.4 g |
| h. Latex of poly(ethyl acrylate and methacrylic acid) | 16 g |
| i. N,N'-ethylenebis-(vinylsulfonacetoamide) | 1.2 g |

This coating solution was applied so that the coated amount of gelatin became 3.0 g/m$^2$.

Spectral sensitizer (II)

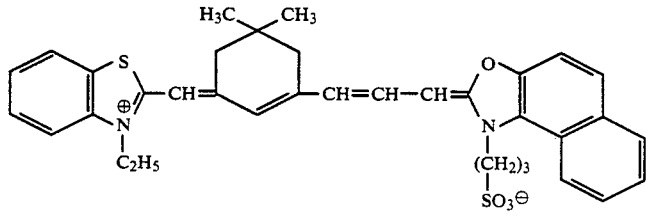

Supersensitizer (III)

-continued

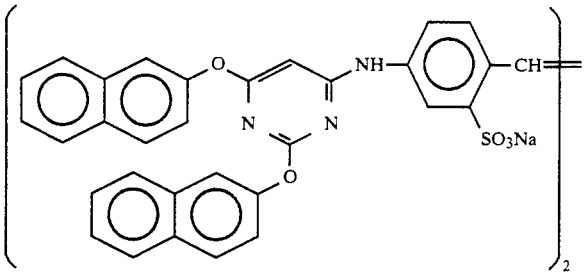

Preservation improving agent (IV)

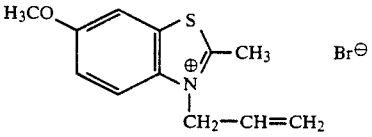

(4) Composition of the Surface Protective Layer

| | | |
|---|---|---|
| a. Gelatin | 100 | g |
| b. Polyacrylamide (molecular weight: 40,000) | 10 | g |
| c. Poly-sodium styrenensulfonate (molecular weight: 600,000) | 0.6 | g |
| d. N,N'-ethylenebis-(vinylsulfonacetamide) | 1.5 | g |
| e. Polymethyl methacrylate fine particles (average particle size: 2.0 μm) | 2.2 | g |
| f. Sodium t-octylphenoxyethoxyethanesulfonate | 1.2 | g |
| g. $C_{16}H_{33}O—(CH_2CH_2O)_{10}—H$ | 2.7 | g |
| h. Poly-sodium acrylate | 4 | g |
| i. $C_8F_{17}SO_3K$ | 70 | mg |
| j. $C_8F_{17}SO_2N(C_3H_7)(CH_2CH_2O)_4(CH_2)_4—SO_3Na$ | 70 | mg |
| k. NaOH (1N) | 4 | ml |
| l. Methanol | 60 | ml |

This coating solution was applied so that the coated amount of gelatin became 1 g/m$^2$.

The samples obtained were left standing at 25° C. and 60% RH for 10 days and then evaluated for the following items:

1. Water Content of the Back Layer After Development Processing

The samples from which the silver halide emulsion layer and surface protective layer were removed by using a sodium hypochlorite aqueous solution were subjected to development processing under the following conditions to measure the weights $W_1$ (g) of the samples after a rinsing step. Then, the samples thus treated were dried in a vacuum drier (an angular vacuum drier DP41 manufactured by Yamato Science Co., Ltd.) at 5 torr and 105° C. for 24 hours to measure the dry weights $W_2$ (g). The water content of the back layer after development processing can be obtained from the following equation:

$$\text{Water content of the back layer after development processing} = (W_1 - W_2)/(S \times X)$$

$W_1$: weight before drying
$W_2$: weight after drying
S: area (m$^2$) of a sample
X: coated amount (g/m$^2$) of gelatin of the back layer NRN automatic developing machine (manufactured by Fuji Photo Film Co., Ltd.):

Developing RD-10 (manufactured by Fuji Photo Film Co., Ltd.) 35° C.

Fixing RF-10 (manufactured by Fuji Photo Film Co., Ltd.) 35° C.

2. Drying Time in an Automatic Developing Machine

The samples were subjected to NRN development processing with an automatic developing machine at 25° C. and 60% RH, wherein line speed is changed to increase drying time by an interval of 20 to 50 seconds. The drying degree of the samples just after development processing were classified by the following 3 grades, wherein only the level of A is practically allowable:

A: completely dried; film is still warm.

B: a little wet; the temperature of the film is at room temperature.

C: not yet dried; the films themselves are adhered.

The shortest drying time in which the drying degree reaches the level of A is shown in Table 1.

The development processing conditions are as follows:

Developing RD-10 (manufactured by Fuji Photo Film Co., Ltd.)

Fixing RF-10 (manufactured by Fuji Photo Film Co., Ltd.)

Drying 55° C.

3. Curling

The samples which were cut to a length of 5 cm and a width of 1 cm are left standing at 25° C. and 60% RH for 3 days. Then, they were left standing at 25° C. and 10% RH for 2 hours thereafter curling is measured. The curling value is obtained from the following equation:

$$\text{Curling value} = 1/(\text{radius of curvature of the sample})$$

wherein when an emulsion layer is inside a curled sample, the curling value is positive; and when the emulsion layer is outside a curled sample, the curling value is negative. A practicably allowable curling value is in the range of −0.02 to +0.02.

The results are shown in Table 1.

TABLE 1

| Sample No. | Gelatin amount of back layer ($g/m^2$) | Binder of Hydrophobic polymer layer Kind | Amount ($g/m^2$) | Ratio of gelatin amounts*1 | Water*2 content | Drying property (sec) | Curling property |
|---|---|---|---|---|---|---|---|
| 101 (Comp.) | 0 | None | None | 0.00 | 0.12 | 30 | 0.09 |
| 102 (Comp.) | 4.0 | None | None | 1.00 | 1.58 | 40 | 0.01 |
| 103 (Comp.) | 0 | B-1 | 1 | 0.00 | 0.11 | 30 | 0.08 |
| 104 (Inv.) | 4.0 | B-1 | 1 | 1.00 | 0.12 | 30 | 0.00 |
| 105 (Inv.) | 4.0 | B-2 | 1 | 1.00 | 0.10 | 30 | −0.01 |
| 106 (Inv.) | 4.0 | B-3 | 3 | 1.00 | 0.11 | 30 | −0.01 |
| 107 (Inv.) | 4.0 | B-4 | 3 | 1.00 | 0.12 | 30 | 0.01 |
| 108 (Inv.) | 4.0 | B-5 | 1 | 1.00 | 0.11 | 30 | 0.00 |
| 109 (Inv.) | 4.0 | B-6 | 1 | 1.00 | 0.12 | 30 | 0.00 |
| 110 (Inv.) | 4.0 | B-7 | 0.5 | 1.00 | 0.11 | 30 | 0.00 |
| 111 (Comp.) | 4.0 | Gelatin | 1 | 1.25 | 1.48 | 45 | −0.02 |
| 112 (Comp.) | 0.4 | None | None | 0.10 | 0.20 | 35 | 0.08 |

*1Ratio of a gelatin amount contained on a back layer side to a gelatin amount contained on an emulsion layer side.
*2Water content on the back layer after development processing.

EXAMPLE 2

The following back layer was coated on one side of the same support as Example 1, followed by drying, and then a polymer layer was coated thereon, followed by drying.

(1) Composition of the Back Layer (Samples 201, and 203 to 214)

| | |
|---|---|
| Gelatin | 3 $g/m^2$ |
| Sodium dodecylbenzenesulfonate | 10 $mg/m^2$ |
| N,N'-ethylenebis-(vinylsulfonacetamide) | 90 $mg/m^2$ |

(2) Composition of the Polymer Layer (Samples 202 to 212)

| | |
|---|---|
| Binder (kind as shown in Table 2 and described below) | coated amount as shown in Table 2 |
| Silica fine particles (average particle size: 3 μm) | 50 $mg/m^2$ |
| $C_8F_{17}SO_3K$ | 5 $mg/m^2$ |
| Sodium dodecylbenzenesulfonate | 25 $mg/m^2$ |

Distilled water was used as a solvent for the coating solution. Drying was carried out at 50° C. for 5 minutes.

| | | |
|---|---|---|
| B-9 | Silicone acryl resin | Cylane ARJ-12L (manufactured by Nippon Junyaku Co., Ltd.) |
| B-10 | Silicone acryl resin | Cylane ARJ-1L (manufactured by Nippon Junyaku Co., Ltd.) |
| B-11 | Aqueous urethane resin | Hydran AP60 (manufactured by Dainippon Ink and Chemicals Inc.) |
| B-12 | Aqueous urethane resin | Hydran AP10 (manufactured by Dainippon Ink and Chemicals Inc.) |
| B-13 | Acrylic type resin | Jurymer ET410 (manufactured by Nippon Junyaku Co., Ltd.) |
| B-14 | Aqueous polyester resin | Finetex ES850 (manufactured by Dainippon Ink and Chemicals, Inc.) |
| B-15 | Vinyl acetate/acrylic type resin | Polykem 49S (manufactured by Dainippon Ink and Chemicals, Inc.) |
| B-16 | Polyethylene type resin | Chemipearl S120 (manufactured by Mitsui Petrochemical Industries, Ltd.) |
| | Cross-linking agents: | |
| H-1 | Melamine type cross-linking agent Beckamine PM-N (manufactured by Dainippon Ink and Chemicals, Inc.) | |
| H-2 | Epoxy type cross-linking agent CR-5L (manufactured by Dainippon Ink and Chemicals Inc.) | |

(2') Composition of the Polymer Layer (Samples 213 and 214)

| | |
|---|---|
| Polymethyl methacrylate B-17 (molecular weight: 100,000) | coated amount as shown in Table 2 |
| Silica fine particles (average particle size: 3 μm) | 50 $mg/m^2$ |

Ethyl acetate was used as a solvent for a coating solution. Drying was carried out at 30° C. for 5 minutes.

The same emulsion layer and surface protective layer as those of Example 1 were coated on the side of the support opposite to the side on which the back layer and polymer layer of these samples were provided.

These samples were left standing at 25° C. and 60% RH for 10 days and then were evaluated in the same manner as Example 1. The results are shown in Table 2.

TABLE 2

| Sample No. | Gelatin amount of back layer ($g/m^2$) | Binder of Hydrophobic polymer layer Kind | Amount ($g/m^2$) | Ratio of gelatin amounts*1 | Water*2 content | Drying property (sec) | Curling property |
|---|---|---|---|---|---|---|---|
| 201 (Comp.) | 4.0 | None | None | 1.00 | 1.62 | 40 | 0.01 |
| 202 (Comp.) | 0 | B-9 | 4 | 0.00 | 0.12 | 30 | 0.09 |
| 203 (Inv.) | 4.0 | B-9 | 1 | 1.00 | 0.10 | 30 | 0.01 |
| 204 (Inv.) | 4.0 | B-10 | 1 | 1.00 | 0.11 | 30 | 0.00 |
| 205 (Inv.) | 4.0 | B-11 | 1 | 1.00 | 0.11 | 30 | 0.01 |
| 206 (Inv.) | 4.0 | B-11 | 1 | 1.00 | 0.13 | 30 | −0.01 |

TABLE 2-continued

| Sample No. | Gelatin amount of back layer ($g/m^2$) | Binder of Hydrophobic polymer layer Kind | Amount ($g/m^2$) | Ratio of gelatin amounts*1 | Water*2 content | Drying property (sec) | Curling property |
|---|---|---|---|---|---|---|---|
| 207 (Inv.) | 4.0 | B-11 | 1 | 1.00 | 0.12 | 30 | 0.01 |
| 208 (Inv.) | 4.0 | B-12 | 1 | 1.00 | 0.12 | 30 | 0.01 |
| 209 (Inv.) | 4.0 | B-13 | 1 | 1.00 | 0.13 | 30 | 0.00 |
| 210 (Inv.) | 4.0 | B-14 | 1 | 1.00 | 0.11 | 30 | −0.01 |
| 211 (Inv.) | 4.0 | B-15 | 1 | 1.00 | 1.12 | 30 | 0.01 |
| 212 (Inv.) | 4.0 | B-16 | 1 | 1.00 | 0.11 | 30 | 0.00 |
| 213 (Inv.) | 4.0 | B-17 | 3 | 1.00 | 0.11 | 30 | 0.00 |

*1Ratio of a gelatin amount contained on a back layer side to a gelatin amount contained on an emulsion layer side
*2Water content on the back layer side after development processing

EXAMPLE 3

The following back layer was coated on one side of the same support as used in Example 1, and then the following fluorinated surface active agent was coated, followed by drying.

(1) Composition of the Back Layer

| | |
|---|---|
| Gelatin | 4 $g/m^2$ |
| N,N'-ethylenebis-(vinylsulfonacetamide) | 90 $mg/m^2$ |

(2) Coating of the Surface Active Agent

Fluorinated surface active agent (kind and coated amount as shown in Table 3 and described below)

Methanol was used as a solvent for the fluorinated surface active agent.

| | |
|---|---|
| F-1 | $C_8F_{17}SO_3K$ |
| F-2 | $C_8F_{17}SO_2N(C_3H_7)(CH_2CH_2O)_3H$ |
| F-3 | $C_8F_{17}SO_2N(C_3H_7)(CH_2CH_2O)_3CH_3$ |

The same emulsion layer and surface protective layer as in Example 1 were coated on the side of the support opposite to the side on which the back layer of these samples was provided.

These samples were left standing at 25° C. and 60% RH for 10 days and then were evaluated in the same manner as Example 1. The results are shown in Table 3.

TABLE 3

| Sample No. | Gelatin amount of back layer ($g/m^2$) | Fluorinated Surfactant | Ratio of gelatin amounts*1 | Water*2 content | Drying property (sec) | Curling property |
|---|---|---|---|---|---|---|
| 301 (Comp.) | 4.0 | None | 1.0 | 1.44 | 40 | 0.01 |
| 302 (Inv.) | 4.0 | F-1 | 1.0 | 0.16 | 30 | 0.00 |
| 303 (Inv.) | 4.0 | F-2 | 1.0 | 0.16 | 30 | 0.01 |
| 304 (Inv.) | 4.0 | F-3 | 1.0 | 0.17 | 30 | 0.01 |

*1Ratio of a gelatin amount contained on a back layer side to a gelatin amount contained on an emulsion layer side
*2Water content on the back layer side after development processing As can be seen from the results shown in Tables 1, 2 and 3, the samples of the present invention are excellent in drying property and anticurl property.

EXAMPLE 4

An electrically conductive layer, a back layer and a polymer layer each having the following composition were coated in this respective order on one side of a polyethylene terephthalate support provided on both sides thereof with a subbing layer and having a thickness of 100 μm. The electrically conductive layer and back layer were simultaneously coated, followed by drying. Then, the polymer layer was coated by a bar coater, followed by drying.

(1) Composition of the Electrically Conductive Layer

| | |
|---|---|
| $SnO_2$ fine particles ($SnO_2/Sb$ = 9/1 by weight, average particle size: 0.25 μm) | added amount as shown in Table 4 |
| Gelatin | 170 $mg/m^2$ |
| Sodium dodecylbenzenesulfonate | 10 $mg/m^2$ |
| 1,3-Divinylsulfonyl-2-propanol | 10 $mg/m^2$ |
| Poly-sodium styrenesulfonate | 9 $mg/m^2$ |

(2) Composition of the Back Layer

| | |
|---|---|
| Gelatin | 2.83 $g/m^2$ |
| Sodium dodecylbenzenesulfonate | 30 $mg/m^2$ |
| 1,3-Divinylsulfonyl-2-propanol | 140 $mg/m^2$ |
| Polyethyl acrylate latex (average particle size: 0.5 μm) | 500 $mg/m^2$ |
| Silicon dioxide fine particles (average particle size: 3.5 μm; pore diameter: 170 Å; surface area: 300 $m^2/g$) | 35 $mg/m^2$ |

(3) Composition of the Polymer Layer

| | |
|---|---|
| Binder (kind as shown in Table 4 and described below) | 2 $g/m^2$ |
| $C_8F_{17}SO_3K$ | 5 $mg/m^2$ |
| Sodium dodecylbenzenesulfonate | 40 $mg/m^2$ |

(Drying was carried out at 180° C. for 3 minutes)

| | |
|---|---|
| B-21 | latex of methyl methacrylate, styrene and acrylic acid (70:25:5). |

-continued

| | |
|---|---|
| B-22 | latex of methyl methacrylate, butyl acrylate and methacrylic acid (60:35:5). |

Subsequently, silver halide emulsion layer 1, silver halide emulsion layer 2, protective layer 1 and protective layer 2 were coated in this order from the support on the opposite side of the support, as described below.

(4) Composition of Silver Halide Emulsion Layer-1

Solution I: water 300 ml, gelatin 9 g.

Solution II: $AgNo_3$ 100 g, water 400 ml.

Solution III: NaCl 37 g, $(NH_4)_3RhCl_6$ 1.1 mg, water 400 ml.

Solution II and solution III were simultaneously added to solution I maintained at 45° C. at a constant speed. After removing water soluble salts from this emulsion by a well known method, gelatin was added and 6-methyl-4-hydroxy-1,3,3a,7-tetraazaindene was further added as a stabilizer. This emulsion was a monodispersed emulsion having an average grain size of 0.20 μm and containing gelatin of 60 g per kg of the emulsion.

The following compounds were added to the emulsion thus obtained.

| | |
|---|---|
| Compound-1 | $6 \times 10^{-6}$ mole/mole of Ag |
| Compound-2 | 60 mg/m$^2$ |
| Compound-3 | 9 mg/m$^2$ |
| Compound-4 | 10 mg/m$^2$ |
| Poly-sodium styrenesulfonate | 40 mg/m$^2$ |
| Sodium N-oleyl-N-methyltaurine | 50 mg/m$^2$ |
| 1,2-Bis(vinylsulfonylacetamide) ethane | 70 mg/m$^2$ |
| 1-Phenyl-5-mercaptotetrazole | 3 mg/m$^2$ |
| Latex of polyethyl acrylate | 460 mg/m$^2$ |

-continued

| | |
|---|---|
| (average particle size: 0.05 μm) | |

The coating solution thus obtained was coated so that a coated amount of gelatin became 1.0 g/m$^2$.

Compound-1

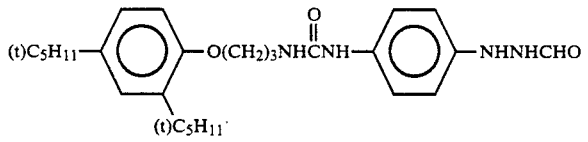

Compound-2

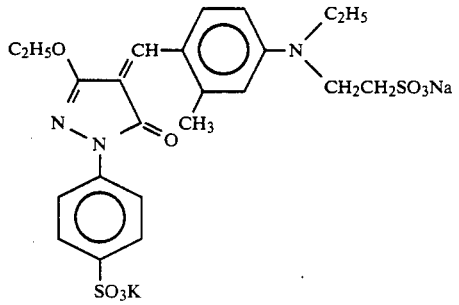

Compound-3

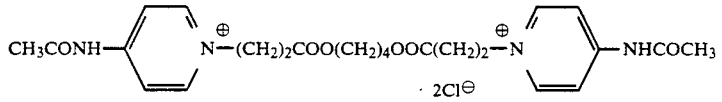

Compound-4

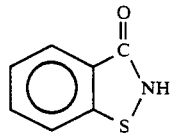

(5) Composition of Silver Halide Emulsion Layer-2

Solution I: water 300 ml, gelatin 9 g.

Solution II: $AgNo_3$ 100 g, water 400 ml.

Solution III: NaCl 37 g, $(NH_4)_3RhCl_6$ 2.2 mg, water 400 ml.

Solution II and solution III were simultaneously added to solution I in the same manner as used for silver halide emulsion-1. This emulsion was a monodispersed emulsion having an average grain size of 0.20 μm.

The following compounds were added to the emulsion thus obtained.

An emulsified dispersion of a hydrazine derivative described later was added so that the addition amount of Compound-5 became $5 \times 10^{-3}$ mole per mole of silver.

| | |
|---|---|
| Compound-2 | 60 mg/m$^2$ |
| Compound-3 | 9 mg/m$^2$ |
| Compound-4 | 10 mg/m$^2$ |
| Poly-sodium styrenesulfonate | 50 mg/m$^2$ |
| Sodium N-oleyl-N-methyltaurine | 40 mg/m$^2$ |
| 1,2-Bis(vinylsulfonylacetamide) ethane | 80 mg/m$^2$ |
| 1-Phenyl-5-mercaptotetrazole | 3 mg/m$^2$ |
| Latex of polyethyl acrylate (average particle size: 0.05 μm) | 400 mg/m$^2$ |

The coating solution thus obtained was coated so that a coated amount of gelatin became 0.6 g/m$^2$.

(6) Composition of Protective Layer-1

| | |
|---|---|
| Gelatin | 0.9 g/m$^2$ |
| α-lipoic acid | 10 mg/m$^2$ |
| Sodium dodecylbenzenesulfonate | 5 mg/m$^2$ |
| Compound-2 | 40 mg/m$^2$ |
| Compound-5 | 20 mg/m$^2$ |
| Poly-sodium styrenesulfonate | 10 mg/m$^2$ |
| 1-Phenyl-5-mercaptotetrazole | 5 mg/m$^2$ |
| Compound-6 | 20 mg/m$^2$ |
| Latex of ethyl acrylate (average particle size: 0.05 μm) | 200 mg/m$^2$ |

(7) Composition of Protective Layer-2

| | |
|---|---|
| Gelatin | 0.5 g/m$^2$ |
| Silicon dioxide fine powder particles (average particle size: 3.5 μm; pore diameter: 25 Å; surface area: 700 m$^2$/g) | 50 mg/m$^2$ |
| Liquid paraffin (gelatin dispersion) | 43 mg/m$^2$ |
| Sodium dodecylbenzenesulfonate | 20 mg/m$^2$ |
| Potassium perfluoro-octanesulfonate | 10 mg/m$^2$ |
| Potassium N-perfluoro-octanesulfonyl-N-propylglycine | 3 mg/m$^2$ |
| Poly-sodium styrenesulfonate | 2 mg/m$^2$ |
| Sulfuric acid ester sodium salt of poly (polymerization degree: 5) oxyethylene nonylphenyl ether | 20 mg/m$^2$ |
| Colloidal silica (particle size: 15 μm) | 20 mg/m$^2$ |

Method for Preparing an Emulsified Dispersion of a Hydrazine Derivative

Solution I

| | |
|---|---|
| Compound-1 | 3.0 g |
| Compound-7 | 1.5 g |
| Poly-N-tert-butylacrylamide | 6.0 g |
| Ethyl acetate | 30 ml |
| Sodium dodecylbenzenesulfonate (70% methanol solution) | 0.12 g |
| Water | 0.12 ml |

-continued

The mixture was heated to 65° C. to uniformly dissolve the components, whereby Solution I was prepared.

Solution II

| | |
|---|---|
| Gelatin | 12 g |
| Compound-4 | 0.02 g |
| Water | 108 ml |

The mixture was heated to 65° C. to uniformly dissolve the components, whereby Solution II was prepared.

Solutions I and II were mixed and stirred at a high speed with a homogenizer (manufactured by Nippon Seiki Co., Ltd) to thereby obtain a fine grain emulsified dispersion. This emulsion was distilled under heating and application of a reduced pressure to remove ethyl acetate. Then, water was added to make the total quantity 250 g. Residual ethyl acetate was 0.2 %.

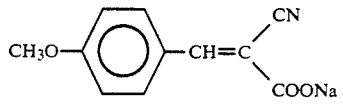

Compound-5

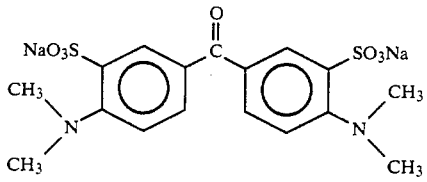

Compound-6

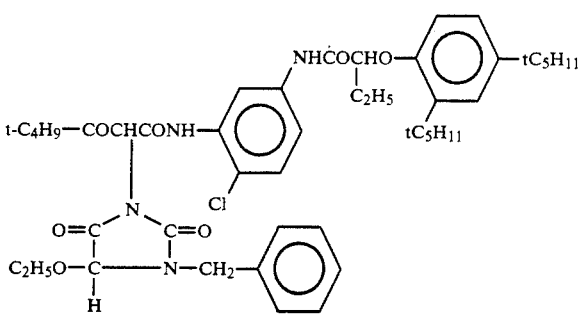

Compound-7

The samples thus obtained were left standing at 25° C. and 60 % RH for 10 days and then were evaluated in the same manner as Example 1.

Surface Resistivity

The samples thus obtained were left standing at 25° C. and 25% RH for 12 hours and then were nipped with brass electrodes (the portion contacting the sample was made of a stainless steel) having an electrode gap of 0.14 cm and a length of 10 cm and the value was measured one minute later with an electrometer TR 8651 manufactured by Takeda Riken Co., Ltd.

Pin Hole

The samples were rubbed with a neoprene rubber roller at 25° C. and 25% RH in a room in which air cleaning is not specifically applied, and then they were subjected to exposure and development (38° C., 20 sec.) and then it was determined whether generation of a pin hole occurred.

The results are shown in Table 4.

TABLE 4

| Sample No. | $SnO_2$ addition ($mg/m^2$) | Back layer | Polymer layer | Ratio of*1 gelatin amt. | Water Content*2 | Surface resistivity (Ω) | Pin hole property*3 | Curling property | Drying property (sec) |
|---|---|---|---|---|---|---|---|---|---|
| 101 (Comp.) | 0 | ○ | X | 1.00 | 1.43 | $10^{14}$ or more | 100 | 0.01 | 90 |
| 102 (Inv.) | 0 | ○ | ○ B-21 | 1.00 | 0.11 | $10^{14}$ or more | 101 | 0.00 | 60 |
| 103 (Comp.) | 300 | ○ | X | 1.00 | 1.48 | 10.8 | 28 | 0.00 | 90 |
| 104 (Inv.) | 300 | ○ | ○ B-21 | 1.00 | 0.12 | 10.4 | 27 | 0.01 | 60 |
| 105 (Inv.) | 0 | ○ | ○ B-22 | 1.00 | 0.12 | $10^{14}$ or more | 100 | 0.00 | 60 |
| 106 (Comp.) | 300 | ○ | X | 1.00 | 1.32 | 10.2 | 27 | −0.01 | 90 |
| 107 (Inv.) | 300 | ○ | ○ B-22 | 1.00 | 0.12 | 10.3 | 26 | 0.01 | 60 |
| 108 (Comp.) | 300 | X | X | 0.06 | 1.30 | 10.6 | 27 | 0.09 | 60 |
| 109 (Comp.) | 300 | X | ○ B-22 | 0.06 | 0.10 | 10.5 | 28 | 0.09 | 60 |

*1Ratio of a gelatin amount contained on a back layer side to a gelatin amount contained on an emulsion layer side
*2Water content on the back layer side after development processing
*3Relative value
○: present
X: absent

EXAMPLE 5

A back layer, an electrically conductive layer and a polymer layer each having the following composition were coated in this order respectively from one side of a polethylene terephthalate support provided on both sides thereof with a subbing layer and having a thickness of 100 μm.

(1) Composition of the Back Layer

| | |
|---|---|
| Gelatin | 3 $g/m^2$ |
| Sodium dodecylbenzenesulfonate | 20 $mg/m^2$ |
| 1,3-Divinylsulfonyl-2-propanol | 150 $mg/m^2$ |
| Polyethyl acrylate latex (average particle size: 0.5 μm) | 500 $mg/m^2$ |

(2) Composition of the Electrically Conductive Layer

| | |
|---|---|
| $SnO_2$ fine particles ($SnO_2/Sb$ = 9/1 by weight, average particle size: 0.25 μm) | added amount as shown in Table 5 |
| Binder (kind: same as that of the polymer layer) | 40 $mg/m^2$ |
| Sodium dodecylbenzenesulfonate | 40 $mg/m^2$ |

(3) Composition of the Polymer Layer

| | |
|---|---|
| Binder (kind as shown in Table 5 and described above in Example 4) | 1 $g/m^2$ |
| $C_8F_{17}SO_3K$ | 5 $mg/m^2$ |
| Sodium dodecylbenzenesulfonate | 50 $mg/m^2$ |
| Polymethyl methacrylate fine particles (average particle size: 3 μm) | 50 $mg/m^2$ |

The back layer, electrically conductive layer and polymer layer were simultaneously coated, followed by drying.

Subsequently, silver halide emulsion layer 1, silver halide emulsion layer 2, protective layer 1 and protective layer 2 of Example 4 were coated in this order respectively from the support on the opposite side thereof, whereby the samples were prepared.

The samples were evaluated in the same manner as in Example 4. The results are shown in Table 5.

TABLE 5

| Sample No. | $SnO_2$ addition ($mg/m^2$) | Back layer | Polymer layer | Ratio of*1 gelatin amt. | Water Content*2 | Surface resistivity (Ω) | Pin hole property*1 | Curling property | Drying property (sec) |
|---|---|---|---|---|---|---|---|---|---|
| 201 (Inv.) | 0 | ○ | ○ B-21 | 1.00 | 0.11 | $10^{14}$ or more | 100 | 0.00 | 60 |
| 202 (Inv.) | 0 | ○ | ○ B-22 | 1.00 | 0.12 | $10^{14}$ or more | 106 | −0.01 | 60 |
| 203 (Inv.) | 165 | ○ | ○ B-21 | 1.00 | 0.12 | 10.2 | 26 | 0.01 | 60 |
| 204 (Inv.) | 165 | ○ | ○ B-22 | 1.00 | 0.12 | 10.8 | 37 | 0.00 | 60 |

*1Ratio of a gelatin amount contained on a back layer side to a gelatin amount contained on an emulsion layer side
*2Water content on the back layer side after development processing
*3Relative value
○: present As can be seen from the results summarized in Tables 4 and 5, the samples into which contain $SnO_2$ fine particles (Samples 404–407, 502 and 503) are excellent in either or all of pin hole property, anticurl property and drying property.

EXAMPLE 6

The following first subbing layer and second subbing layer were applied on the both sides of a biaxial oriented polyethylene terephthalate support with a thickness of 100 μm in order from the side closer to the support, whereby the subbing samples 1 to 5 were prepared.

(1) Composition for the First Subbing Layer

| | |
|---|---|
| Vinylidene chloride latex (the kind as shown in Table 6) | 15 parts by weight |
| Sodium 2,4-dichloro-6-hydroxy-1,3,5-triazine | 0.2 parts by weight |
| Colloidal silica (Snowtex ZL manufactured by Nissan Chemical Co., Ltd.) | 1.1 parts by weight |
| Polystyrene fine particles (an average particle size: 3 μm) | added so that a coated amount became 5 mg/m$^2$ |
| Distilled water was added to make the total quantity | 100 parts by weight |
| pH | adjusted with a 10% KOH aqueous solution to 6 |
| Temperature of a coating solution | 10° C. |
| Dry thickness | as shown in Table 6 |
| Drying condition | at 180° C. for two minutes |

(2) Composition for the Second Subbing Layer

| | |
|---|---|
| Gelatin | 1 part by weight |
| Methylcellulose | 0.05 part by weight |
| Compound a' | 0.02 part by weight |

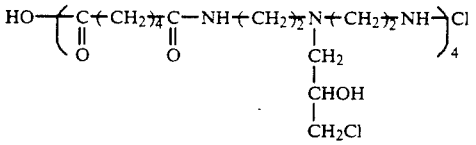

| | |
|---|---|
| $C_{12}H_{25}O(CH_2CH_2O)_{10}H$ | 0.03 part by weight |
| Compound b' | $3.5 \times 10^{-3}$ part by weight |

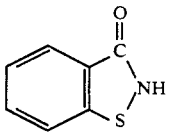

| | |
|---|---|
| Acetic acid | 0.2 part by weight |
| Water was added to make the total quantity | 100 parts by weight |
| Temperature of a coating solution | 25° C. |
| Dry thickness | 0.1 g/m$^2$ |
| Drying condition | at 170° C. for two minutes |

Next, The back layer and polymer layer of the following compositions were coated on one side of this subbing sample in order from the side closer to the support.

(3) Composition of the Back Layer

| | |
|---|---|
| Gelatin | 3.0 g/m$^2$ |
| Ethyl acrylate latex (an average particle size: 0.1 μm) | 500 mg/m$^2$ |
| 1,3-Divinylsulfonyl-2-propanol | 150 mg/m$^2$ |
| Poly-sodium styrenesulfonate | 55 mg/m$^2$ |
| Polymethyl methacrylate particles (an average particle size: 3 μm) | 40 mg/m$^2$ |

(4) Composition of the Polymer Layer

| Binder (the kind as shown in Table 6) | Coated amount as shown in Table 6 |
|---|---|
| $C_8F_{17}SO_3K$ | 5 mg/m$^2$ |
| B-31 | Latex consisting of methyl methacrylate, butyl methacrylate, styrene and methacrylic acid in the ratio of 50:40:8:2. |
| B-32 | Latex consisting of methyl methacrylate, butyl methacrylate, styrene and methacrylic acid in the ratio of 35:50:14:1. |
| B-33 | Latex consisting of methyl methacrylate, ethyl acrylate, styrene and acrylic acid in the ratio of 60:30:9:1. |

Subsequently, a silver halide emulsion layer 1, a silver halide emulsion layer 2, a protective layer 1, and a protective layer 2 were applied on the reverse side of the support in order from the side closer to the support.

(5) Composition for the Silver Halide Emulsion Layer 1

Solution I: water 300 ml and gelatin 9 g.

Solution II: silver nitrate 100 g and water 400 ml.

Solution III A: sodium chloride 37 g, $(NH_4)_3RhCl_6$ 1.1 mg and water 400 ml

The solution II and solution III A were added simultaneously to the solution I kept at 45° C. at a constant speed. After removing the soluble salts by a conventional method well known in the art, gelatin was added and then 6-methyl-4-hydroxy-1,3,3a,7-tetrazaindene was added as a stabilizer. This emulsion was a monodispersed emulsion having an average grain size of 0.02 μm and had a gelatin content of 60 g per kg of the emulsion.

The following compounds were added to the emulsion A thus obtained:

| | |
|---|---|
| Compound a | $5 \times 10^{-3}$ mol/mol of Ag |
| Compound b | 120 mg/m$^2$ |
| Compound c | 20 mg/m$^2$ |
| Compound d | 20 mg/m$^2$ |
| Compound e | 9 mg/m$^2$ |

Compound a

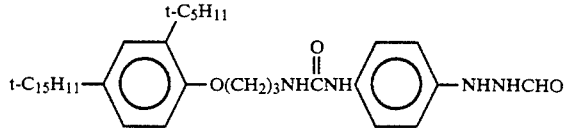

Compound b

-continued

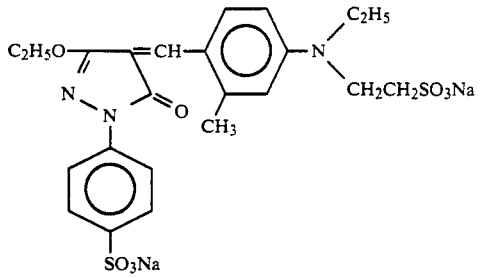

Compound c

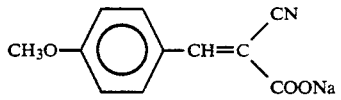

Compound d

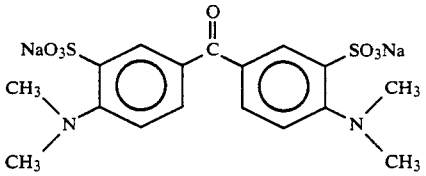

Compound e

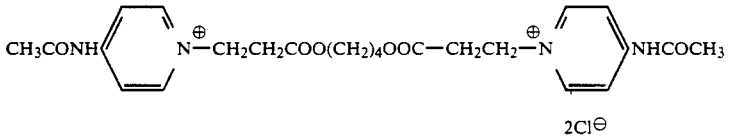

| | |
|---|---|
| Poly-sodium styrenesulfonate | 30 mg/m$^2$ |
| Sodium N-oleyl-N-methyltaurine | 50 mg/m$^2$ |
| 1,2-Bis(vinylsulfonylacetamide) ethane | 70 mg/m$^2$ |
| 1-Phenyl-5-mercaptotetrazole | 3 mg/m$^2$ |
| Ethyl acrylate latex (an average grain size: 0.1 μm) | 40 mg/m$^2$ |

The coating solution thus obtained was coated so that the coated silver amount became 1 g/m$^2$.

(6) Composition for the Silver Halide Emulsion Layer 2

Solution I: water 300 ml and gelatin 9 g.

Solution II: silver nitrate 100 g and water 400 ml.

Solution III B: sodium chloride 37 g, $(NH_4)_3RhCl_6$ 2.2 mg and water 400 ml.

The emulsion B was prepared in the same manner as the emulsion A by using the solution III B instead of the solution III A. This emulsion was a monodispersed emulsion having an average grain size of 0.20 μm.

The same compounds a to e and other compounds as those used for preparing the emulsion A were added to the emulsion B thus obtained:

| | |
|---|---|
| Compound a | $5 \times 10^{-3}$ mol/mol of Ag |
| Compound b | 120 mg/m$^2$ |
| Compound c | 100 mg/m$^2$ |
| Compound d | 100 mg/m$^2$ |
| Compound e | 9 mg/m$^2$ |
| Poly-sodium styrenesulfonate | 50 mg/m$^2$ |
| Sodium N-oleyl-N-methyltaurine | 40 mg/m$^2$ |
| 1,2-Bis(vinylsulfonylacetamide) ethane | 85 mg/m$^2$ |
| 1-Phenyl-5-mercaptotetrazole | 3 mg/m$^2$ |
| Ethyl acrylate latex (an average particle size: 0.1 μm) | 40 mg/m$^2$ |

The coating solution thus obtained was coated so that the coated silver amount became 0.6 g/m$^2$.

(7) Composition for the Protective Layer 1

| | |
|---|---|
| Gelatin | 0.9 g/m$^2$ |
| Lipoic acid | 5 mg/m$^2$ |
| Sodium dodecylbenzenesulfonate | 5 mg/m$^2$ |
| Compound c | 20 mg/m$^2$ |
| Sulfuric acid ester sodium salt of poly-oxyethylene nonylphenol (polymerization degree: 5) | 5 mg/m$^2$ |
| Poly-sodium styrenesulfonate | 10 mg/m$^2$ |
| Compound f | 20 mg/m$^2$ |

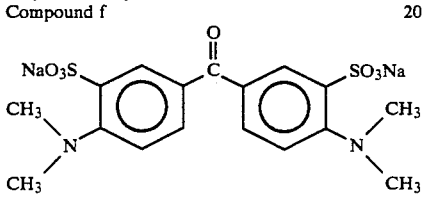

| | |
|---|---|
| Ethyl acrylate latex (an average grain size: 0.1 μm) | 200 mg/m$^2$ |

(8) Composition for the Protective Layer 2

| | |
|---|---|
| Gelatin | 0.6 g/m$^2$ |
| Polymethyl methacrylate fine particles (an average grain size: 3 μm) | 60 mg/m$^2$ |
| Sodium dodecylbenzenesulfonate | 20 mg/m$^2$ |
| Potassium N-perfluorooctanesulfonyl-N-propyl glycine | 3 mg/m$^2$ |
| Sulfuric acid ester sodium salt of polyoxyethylene nonylphenol (polymerization degree: 5) | 15 mg/m$^2$ |
| Poly-sodium styrenesulfonate | 2 mg/m$^2$ |

The samples thus obtained were stored at 25° C. and 60% RH for two weeks and then subjected to the following evaluations.

Water Content of the Back Layer After a Development Processing

The samples in which the silver halide emulsion layers and surface protective layers are removed with an aqueous solution of sodium hypochlorite are subjected to a development processing at the following conditions to measure the weight $W_1$ (g) of the samples after the completion of a rinsing step.

Subsequently, the samples are dried in a vacuum drying equipment (a rectangular vacuum drying equipment DP 41 manufactured by Yamato Kagaku Co., Ltd.) at 5 Torr and 105° C. for 24 hours and then the weight $W_2$ (g) is measured.

The water content is calculated from the following equation with $W_1$, $W_2$, a sample area S (m$^2$) and a gelatin coated amount X (g/m$^2$).

Water content of the back layer after a development processing $=(W_1-W_2)/(S\times X)$ FG 660 automatic developing machine (manufactured by Fuji Photo Film Co., Ltd.)

Developing GR-D1((manufactured by Fuji Photo Film Co., Ltd.) 35° C.

Fixing GF-F1 (manufactured by Fuji Photo Film Co., Ltd.) 35° C.

Evaluation of a Dimension Variation According to the Processing

Two holes with a diameter of 8 mm are bored at the interval of 200 mm on a sample and are left for standing at 25° C. and 30% RH. Then, the interval between the two holes is precisely measured with a pin gauge having an accuracy of 1/1000 mm, wherein the distance is designated as X mm. Subsequently, it is subjected to the developing, fixing, rinsing and drying processing with an automatic developing machine, and then the dimension is measured five minutes later, which is designated as Y mm. The dimension variation (%) is expressed by the value obtained by dividing (Y−X) with 200 and multiplying by 100..

The dimension variation of ±0.01% or less is regarded as no problem in a practical application and that of ±0.007% or less is regarded as very preferable.

A development processing was carried out with an automatic developing machine FG-660 manufactured by Fuji Photo Film Co., Ltd. in the developing solution GR-D1 and fixing solution GR-F1 each manufactured by the same company at the processing conditions of 38 ° C. and 20 seconds, wherein the drying temperature was 45° C.

Curling

A sample which was cut to a length of 5 cm and a width 1 cm was stored at 25° C. and 60% RH for 3 days. Then , it was transferred to an atmosphere of 25° C. and 10% RH and the curling was measured 2 hours after that.

The curling value was obtained from the following defined equation:

Curling value = 1/(a radius cm of a curvature of the sample)

Provided that when an emulsion side is at an inside, the curling value is designated as positive and that when the emulsion side is at an outside, the curling value is designated as negative.

The curling value which is allowed in a practical application is in the range of −0.02 to +0.02.

TABLE 6

| Sample No. | Material of 1st subbing layer | Thickness of 1st subbing layer (μm) | Gelatin amount of back layer (g/m$^2$) | Ratio of gelatin amounts*1 | Binder of Polymer layer Kind | Binder of Polymer layer Thickness (μm) | Water Content*2 | Dimension Change | Curling property |
|---|---|---|---|---|---|---|---|---|---|
| 1 (Inv.) | V-16 | 0.3 | 3.0 | 1.00 | B-31 | 1 | 0.12 | 0.007 | 0.00 |
| 2 (Inv.) | V-16 | 0.5 | 3.0 | 1.00 | B-31 | 1 | 0.10 | 0.005 | 0.01 |
| 3 (Inv.) | V-16 | 0.9 | 3.0 | 1.00 | B-31 | 1 | 0.11 | 0.004 | 0.01 |
| 4 (Inv.) | V-15 | 0.9 | 3.0 | 1.00 | B-32 | 1 | 0.11 | 0.005 | 0.00 |
| 5 (Inv.) | V-14 | 0.9 | 3.0 | 1.00 | B-33 | 1 | 0.12 | 0.005 | 0.01 |

*1Ratio of a gelatin amount contained on a back layer side to a gelatin amount contained on an emulsion layer side
*2Water content on the back layer side after development processing

EXAMPLE 7

The back layer and polymer layer of the following compositions were applied on one side of a polyethylene terephthalate support with a thickness of 100 μm, which was provided on the both sides thereof with a subbing layer, in order from the side closer to the support, and a coated support was dried at 50° C. for 5 minutes.

(1) Composition for the Back Layer

| | |
|---|---|
| Gelatin | 3.0 g/m$^2$ |
| Polymethyl methacrylate fine particles (an average particle size: 3 μm) | 50 mg/m$^2$ |
| Sodium dodecylbenzensulfonate | 10 mg/m$^2$ |
| Poly-sodium styrenesulfonate | 20 mg/m$^2$ |
| N,N'-ethylenebis-(vinylsulfonacetamide) | 40 mg/m$^2$ |
| Ethyl acrylate latex (an average particle size: 0.1 μm) | 1.0 g/m$^2$ |

(2) Composition for the Polymer Layer

| | |
|---|---|
| Binder (the kind as shown in Table 7) | as shown in Table 7 |
| Polymethyl methacrylate fine particles (an average particle size: 3 μm) | 10 mg/m$^2$ |
| $C_8F_{17}SO_3K$ | 5 mg/m$^2$ |

(Distilled water was used as a solvent for the coating solution)

Next, a dying layer (3), an emulsion layer (4), a lower protective layer (5) and an upper protective layer (6) were simultaneously coated on the reverse side of the support.

(3) Composition for the Drying Layer

| | |
|---|---|
| Gelatin | 1.0 g/m$^2$ |
| Exemplified compound (Dye III-5) (III-5) | 0.075 g/m$^2$ |

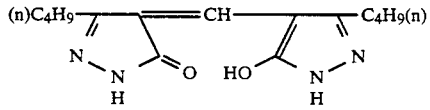

| | |
|---|---|
| Exemplified compound (Dye III-3) (III-3) | 0.070 g/m$^2$ |

172

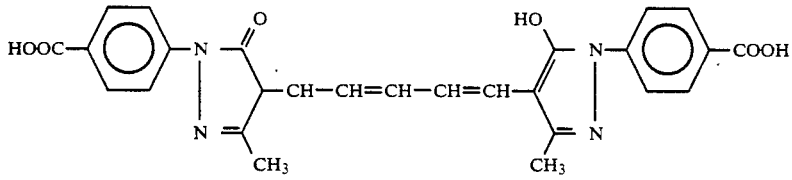

| | |
|---|---|
| Phosphoric acid | 0.015 g/m$^2$ |
| Sodium dodecylbenzensulfonate | 0.015 g/m$^2$ |
| Poly-sodium styrenesulfonate | 0.025 g/m$^2$ |
| 1,1'-Bis(vinylsulfonyl) methane | 0.030 g/m$^2$ |

The Preparing Methods of the Exemplified Compounds III-5 and III-3

The method of JP-A-63-197943 was correspondingly applied to the prepared methods in the present invention.

Water 434 ml and a 6.7% solution of a Triton X-200R surface active agent (TX-200R) 53 g (marketed by Rohm & Haas Co., Ltd.) were put in a bottle of 1.5 liter with a screwed cap. The dye 20 g and the beads 800 ml with a diameter of 2 mm of zirconium dioxide ($ZrO_2$) were put therein and tightly covered with the cap. This bottle was put in a mill and rotated for 4 days to crash the content.

The crashed content was added to a 12.5% gelatin aqueous solution 160 g and a mixture was put in a roll mill for 10 minutes to reduce a foam. The mixture thus obtained was filtered to remove the beads $ZrO_2$. This mixture contained the fine particles with an average particle size of about 0.3 μm and therefore, it was classified with a centrifugal separation method to obtain the fine particles with an average particle size of 1 μm or less.

(1) Preparation of the Emulsion

| | |
|---|---|
| Solution I | |
| Water | 1000 ml |
| Gelatin | 20 g |
| Sodium chloride | 20 g |
| 1,3-Dimethylimidazolidine-2-thione | 20 mg |
| Sodium benzenesulfonate | 6 mg |
| Solution II | |
| Water | 400 ml |
| Silver nitrate | 100 g |
| Solution III | |
| Water | 400 ml |
| Sodium chloride | 30.5 g |
| Potassium bromide | 14 g |
| Potassium hexachloroiridate (III) (a 0.001% aqueous solution) | 15 ml |
| Ammonium hexabromorhodate (III) (a 0.001% aqueous solution) | 1.5 ml |

The solution II and solution III were simultaneously added to the solution I kept at 38° C. and pH 4.5 over a period of 10 minutes while stirring, whereby the nucleus grains were prepared. Subsequently, the following solution IV and solution V were added thereto over a period of 10 minutes. Further, potassium iodide 0.15 g was added to complete the preparation of the nucleus grains.

| | |
|---|---|
| Solution IV | |
| Water | 400 ml |
| Silver nitrate | 100 g |
| Solution V | |
| Water | 400 ml |
| Sodium chloride | 30.5 g |
| Potassium bromide | 14 g |
| $K_4Fe(CN)_6$ | $1 \times 10^{-5}$ mol/mol of Ag |

Thereafter, the emulsion thus prepared was washed with a conventional flocculation method and gelatin 40 g was added thereto.

This emulsion was adjusted to pH 5.3 and pAg 7.5, and sodium thiosulfate 5.2 mg, chloroauric acid 10.0 mg, and N-dimethylselenourea 2.0 mg were added thereto, followed by further adding sodium benzenesulfonate 8 mg and sodium benzenesulfinate 2.0 mg to thereby provide a chemical sensitization at 55° C. so that an optimum sensitivity was obtained. Finally, there were prepared the silver iodochlorobromide cubic grain emulsion containing 80 mole % of silver chloride and having an average grain size of 0.20 μm.

Subsequently, the sensitizing dye (1) $5\times10^{-4}$ mole/mole of Ag was added to provide an ortho sensitization. Further added were hydroquinone and 1-phenyl-5-mercaptotetrazole in the amounts of 2.5 g and 50 mg each per mole of Ag, respectively, colloidal silica (Snowtex C with an average particle size of 0.015 μm, manufactured by Nissan Chemical Co., Ltd.) by 30% by weight based on an amount of gelatin, a polyethyl acrylate latex (0.05 μm) as a plasticizer by 40% by weight based on an amount of gelatin, and 1,1,-bis(vinylsulfonyl) methane as a hardener in the amount of 15 to 150 mg/m² per g of gelatin so that a swelling rate become as shown in Table 7.

This coating solution was applied so that the coated amount of silver and gelatin were 3.0 g/m² and 1.5 g/m², respectively.

Sensitizing dye (1)

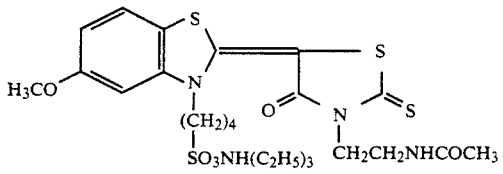

(4) Composition for the Lower Protective Layer

| | |
|---|---|
| gelatin | 0.25 g/m² |
| Sodium benzenesulfonate | 4 mg/m² |
| 1,5-Dihydroxy-2-benzaldoxime | 25 mg/m² |
| Polyethyl acrylate latex | 125 mg/m² |

(5) Composition for the Upper Protective Layer

| | |
|---|---|
| Gelatin | 0.25 g/m² |
| Silica matting agent (an average particle size: 2.5 μm) | 50 mg/m² |
| Compound (1) (a dispersion of a sliding agent in gelatin) | 30 mg/m² |
| Colloidal silica (Snowtex C manufactured by Nissan Chemical Co., Ltd.) | 30 mg/m² |
| Compound (2) | 5 mg/m² |
| Sodium dodecylbenzenesulfonate | 22 mg/m² |

Every dynamic frictional coefficient of these samples was in the range of 0.22±0.03 (25° C. and 60% RH, a sapphire needle with a diameter of 1 mm, the load of 100 g, and the speed of 60 cm/min).

Compound (1)

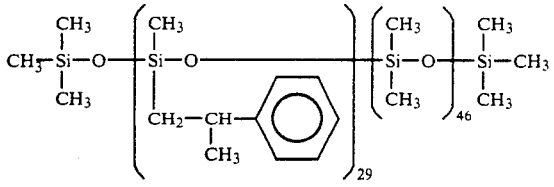

Compound (2)

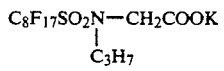

The samples thus obtained were stored at the atmosphere of 25° C. and 60% RH for a week, and then was subjected to the following evaluations:

(1) Swelling Rate of the Back Layer and Polymer Layer with a Processing Solution The measurement of the layer thicknesses d of the back layer and polymer layer after the completion of a rinsing step: the samples in which the rinsing step in the following development processing is over are subjected to a freeze drying with liquid nitrogen. The cut pieces thereof are observed with a scanning type electron microscope to obtain d of the back layer and polymer layer, respectively.

The measurement of the layer thicknesses $d_0$ of the back layer and polymer layer after drying: the samples in which the drying step in the following development processing is over are subjected to an observation of the cut pieces thereof with a scanning type electron microscope to obtain $d_0$ of the back layer and polymer, respectively.

(2) Swelling Rate of the Emulsion Layer+Protective Layer

A layer thickness before swelling is measured with an electron micrometer manufactured by Anritsu Electric Co., Ltd. at a measurement force of 30±5 g and a swollen layer at the measurement force of 2±0.5 g to obtain the swelling rate.

(3) Curl

A sample which was cut to a length of 5 cm and a width 1 cm was stored at 25° C. and 60% RH for 3 days. Then , it was transferred to an atmosphere of 25° C. and 10% RH and the curl was measured 2 hours after that.

The curl value was obtained from the following defined equation:

Curl value = 1/(a radius cm of a curvature of the sample)

Provided that when an emulsion side is at an inside, the curling value is designated as positive and that when the emulsion side is at an outside, the curl value is designated as negative.

The curl value which is allowed in a practical application is in the range of −0.02 to +0.02.

(4) Strength of a Wet Layer

After a sample is dipped in distilled water of 25° C. for 5 minutes, a sapphire needle with a radius of 0.4 mm is pressed on a layer surface of the sample and the load of the needle is continuously changed while moving the needle at the speed of 10 mm/second to measure the load by which the layer is broken.

(5) Drying Property

A sample of a large size (51 cm×61 cm) is subjected to a development processing with an automatic developing machine FG-710 NH (manufactured by Fuji Photo Film Co., Ltd.) at the atmosphere of 25° C. and 60% RH while changing a drying time by changing a line speed at a drying temperature of 50° C., whereby the shortest drying time necessary for obtaining a completely dried sample immediately after processing is determined.

(6) Jamming

Twenty sheets of a sample of a quarter size (25.4 cm×30.5 cm) are processed at the following processing conditions with the above automatic developing machine FG-710 NH in which the rollers in a drying unit are replaced with the smooth rollers made of a phenol resin to observe the generation of jamming.

Processing Conditions

| | | |
|---|---|---|
| Developing | 38° C. | 14.0 seconds |
| Fixing | 38° C. | 9.7 seconds |
| Rinsing | 25° C. | 9.0 seconds |
| Squeezing | | 2.4 seconds |
| Drying | 55° C. | 8.3 seconds |
| Total | | 43.4 seconds |
| Line speed | | 2800 mm/min |

The developing solution and fixing solution each having the following composition were used and the replenishing was carried out at the replenishing amount of 200 ml per $m^2$ of a film.

| Composition of the developing solution (processing temperature: 38° C.): | |
|---|---|
| Sodium 1,2-dihydroxybenzene-3,5-disulfonate | 0.5 g |
| Diethylenetriaminepentacetic acid | 2.0 g |
| Sodium carbonate | 5.0 g |
| Boric acid | 10.0 g |
| Potassium sulfite | 85.0 g |
| Sodium bromide | 6.0 g |
| Diethylene glycol | 40.0 g |
| 5-Methylbenzotriazole | 0.2 g |
| Hydroquinone | 30.0 g |
| 4-Hydroxymethyl-4-methyl-1-phenyl-3-pyrazolidone | 1.6 g |
| 2,3,5,6,7,8-Hexahydro-2-thioxo-4-(1H)-quinazolinone | 0.05 g |
| Sodium 2-mercaptobenzimidazole-5-sulfonate | 0.3 g |
| Potassium hydroxide and water were added to | 1 liter |
| pH was adjusted to | 0.7 |

-continued

| Composition of the fixing solution (processing temperature: 38° C.): | |
|---|---|
| Sodium thiosulfate | 160 g/liter |
| 1,4,5-Trimethyl-1,2,4-triazolium-3-thiolate | 0.25 mole/liter |
| Sodium bisulfite | 30 g/liter |
| Disodium ethylenediaminetetraacetate dihydrate | 0.025 g/liter |
| pH was adjusted with sodium hydroxide to | 6.0 |

The results thus obtained are shown in Table-7.

As apparent from the results summarized in Table 7, it can be found that the samples of the present invention have a strong wet layer strength and the excellent curl and drying property and does not cause the jamming in the automatic developing machine.

TABLE 7

| Sample No. | Presence of back layer | Polymer layer Kind | Polymer layer Thickness (μm) | d/d0 of back layer | d/d0 of polymer layer | Gelatin ratio*1 | Water content*2 | Swelling rate*3 (%) | Curl | Wet layer strength (g) | Drying (sec) | Jamming |
|---|---|---|---|---|---|---|---|---|---|---|---|---|
| 1 (Inv.) | Yes | P-1 | 1.0 | 1.00 | 1.00 | 1.00 | 0.12 | 200 | 0.00 | 95 | 14 | None |
| 2 (Inv.) | Yes | P-1 | 1.0 | 1.00 | 1.00 | 1.00 | 0.11 | 150 | 0.00 | 100 | 11 | None |
| 3 (Inv.) | Yes | P-1 | 1.0 | 1.00 | 1.00 | 1.00 | 0.11 | 100 | 0.01 | 108 | 7 | None |
| 4 (Inv.) | Yes | P-2 | 1.0 | 1.00 | 1.00 | 1.00 | 0.12 | 200 | 0.00 | 96 | 13 | None |
| 5 (Inv.) | Yes | P-2 | 1.0 | 1.00 | 1.00 | 1.00 | 0.11 | 150 | 0.00 | 102 | 10 | None |
| 6 (Inv.) | Yes | P-2 | 1.0 | 1.00 | 1.00 | 1.00 | 0.12 | 100 | 0.00 | 108 | 8 | None |

P-1: Latex consisting of methyl methacrylate and acrylic acid (97:3)
P-2: Aqueous urethane resin Hydran AP 60 (manufactured by Dainippon Ink and Chemicals Inc.)
*1Ratio of a gelatin amount contained on a back layer side to a gelatin amount contained on an emulsion layer side
*2Water content on the back layer side after development processing
*3Swelling rate of an emulsion layer + a protective layer While the invention has been described in detail and with reference to specific embodiments thereof, it will be apparent to one of ordinary skill in the art that various changes and modifications can be made therein without departing from the spirit and scope thereof.

What is claimed is:

1. A silver halide photographic material comprising
(a) a support;
(b) at least one silver halide emulsion layer containing hydrophilic colloid as a binder provided on one side of the support (side A), and
(c) at least one light-insensitive layer containing hydrophilic colloid as a binder provided on the side of the support opposite from the side with the silver halide emulsion layer (side B), wherein a weight ratio of the hydrophilic colloid contained in the at least one light-insensitive layer on side B to the hydrophilic colloid in the at least one silver halide emulsion layer on side A is 0.3 or greater, and the light-insensitive layer on side B has a water content of 0.2 g or less per gram of hydrophilic colloid after finishing a rinsing step in development processing.

2. The silver halide photographic material of claim 1, further comprising at least one layer containing at least one hydrophobic polymer as a binder on side B, provided farther from the support than the light-insensitive layer.

3. The silver halide photographic material of claim 1, wherein a surface resistivity of at least one side of the support is $10^{12}\Omega$ or less at 25° C. and 25% relative humidity.

4. The silver halide photographic material of claim 2, wherein the binder is selected from the group consisting of a homopolymer consisting of a single monomer and a copolymer consisting of two or more monomers.

5. The silver halide photographic material of claim 2, wherein the at least one layer has a thickness in the range of 0.05 to 10 μm.

6. The silver halide photographic material of claim 5, wherein the thickness is 0.1 to 5 μm.

7. The silver halide photographic material of claim 3, wherein the surface resistivity is lowered by an electrically conductive layer.

8. The silver halide photographic material of claim 7, wherein the electrically conductive layer comprises at least one electrically conductive material which is selected from the group consisting of electrically conductive metal oxides and electrically conductive high molecular weight compounds.

9. The silver halide photographic material of claim 8, wherein the electrically conductive metal oxide is crystalline metal oxide particles.

10. The silver halide photographic material of claim 8, wherein the electrically conductive metal oxide in an electrically conductive metal oxide having an oxygen deficiency and containing a small amount of different kinds of atoms which form donors for metal oxides.

11. The silver halide photographic material of claim 8, wherein the electrically conductive metal oxide is selected from the group consisting of ZnO, $TiO_2$, $SnO_2$, $Al_2O_3$, $In_2O_3$, SiO2, MgO, BaO, $MoO_3$, $V_2O_5$, and composition oxides thereof.

12. The silver halide photographic material of claim 10, wherein the amount of different kinds of atoms used is 0.01 to 30 mol %.

13. The silver halide photographic material of claim 12, wherein the amount of different kinds of atoms used is 0.1 to 10 mol %.

14. The silver halide photographic material of claim 8, wherein the electrically conductive metal oxide has a volume resistivity of $10^9$ Ω-cm or less.

15. The silver halide photographic material of claim 14, wherein the volume resistivity is $10^5$ Ω-cm or less.

16. The silver halide photographic material of claim 9, wherein the particle size of the electrically conductive metal oxide is 10 μm or less.

17. The silver halide photographic material of claim 16, wherein the particle size is 2 μm or less.

18. The silver halide photographic material of claim 16, wherein the particle size is 0.5 μm or less.

19. The silver halide photographic material of claim 1, further comprising a subbing layer containing vinylidene chloride copolymer and having a thickness of at least 0.3 μm.

20. The silver halide photographic material of claim 1, wherein the swelling rate of the hydrophilic colloid layer provided on side A is 200% or less.

* * * * *